United States Patent [19]

Hesterberg et al.

[11] Patent Number: 4,607,895

[45] Date of Patent: Aug. 26, 1986

[54] SALES DISPLAY CASE

[76] Inventors: Detlef Hesterberg, Auf dem Rode 29, 5800 Hagen 7; Dietrich Hesterberg, Lohestr. 9, 5800 Hagen 1, both of Fed. Rep. of Germany

[21] Appl. No.: 673,489

[22] Filed: Nov. 20, 1984

[30] Foreign Application Priority Data

Feb. 8, 1984 [DE] Fed. Rep. of Germany ... 8403748[U]

[51] Int. Cl.[4] ..... A47F 3/14

[52] U.S. Cl. ..... 312/126; 312/140.3

[58] Field of Search ..... 312/114, 119, 122, 126, 312/128, 137, 140.1, 140.3, 140.4; 108/27

[56] References Cited

U.S. PATENT DOCUMENTS

| | | | |
|---|---|---|---|
| 965,237 | 7/1910 | Shaffer | 312/126 |
| 2,227,854 | 1/1941 | Walters | 312/114 |
| 2,262,088 | 11/1941 | Bofenkamp | 211/181 |
| 2,563,746 | 8/1951 | Ressinger | 312/309 |

FOREIGN PATENT DOCUMENTS

| | | | |
|---|---|---|---|
| 892761 | 8/1953 | Fed. Rep. of Germany | 312/128 |
| 2401731 | 7/1975 | Fed. Rep. of Germany | 312/140.1 |
| 32881 | 7/1963 | Finland | 108/27 |

*Primary Examiner*—William E. Lyddane
*Assistant Examiner*—Gerald A. Anderson
*Attorney, Agent, or Firm*—Karl F. Ross; Herbert Dubno

[57] ABSTRACT

A novel sales display case for baked goods, confectionaries and the like has a support base with a horizontal work plate extending the entire width of the case and positioned toward the rear of the support base, as well as a display structure opening at its rear, and a plurality of goods display plates positioned on the floor of the display structure inclined toward the front thereof. A considerably better presentation and accessibility with comparatively large goods capacity is achieved by attaching the work plate substantially level with the rear directed ends of the goods display plates in the display structure, by making the goods display plates detachable and rectangular and by providing an upwardly protruding lip on the free, rear long edge of the work plate. The work plate and lip are so structured that the space, between the rear ends of the goods display plates set in the cabinet structure and the protruding lip attached to the work plate parallel to said rear ends, is equal to or greater than the width of and smaller than the length of the goods display plates placed on the work plate.

5 Claims, 3 Drawing Figures

SALES DISPLAY CASE

FIELD OF THE INVENTION

Our present invention relates to a sales display case especially for baked goods, confectionaries and the like and, more particularly, to a display case having a support or base with a rearwardly extending horizontal work plate or table which extends the entire length of the case, and a rearwardly opening display or window structure which has a plurality of goods display mounting plates disposed on its floor and inclined toward the front of the case.

BACKGROUND OF THE INVENTION

Known sales display cases of this type have, in the display structure between the floor of that structure on which are positioned goods display mounting plates and the roof of that structure, at least one intermediate structure for mounting additional goods intended to increase the display capacity. However, these intermediate display mounting structures tend to obstruct the viewing of the goods display plates or the like below them. They will also reduce the accessibility for the goods positioned on the floor of the structure.

OBJECTS OF THE INVENTION

It is an object of this invention to provide a sales display case in which accessibility of the goods is greatly improved with a comparatively large goods display capacity.

It is also an object of this invention to provide a simple sales display case which facilitates a sales presentation which retains desirable goods storage characteristics, especially a comparatively large goods capacity.

SUMMARY OF THE INVENTION

These objects and others which will become apparent hereinafter are attained, in accordance with the invention, in a display case comprising a base, a transparent rearwardly open display structure on this base, a downwardly or forwardly sloping floor in this structure, a plurality of display plates of rectangular configuration (preferably elongated) on this floor most desirably in longitudinally and laterally contiguous relationship so that goods on these plates or trays can be viewed unobstructedly through the rearwardly and upwardly inclined viewing window of the structure, and a horizontal rearwardly extending work table at the rear of the structure located substantially at the level of the upper edge of the floor.

According to the invention, while excluding means within the structure for enlarging the display capacity, we provide means whereby this table can be used as an additional display area instead of merely forming a work surface for the vendor or other personnel.

This is achieved according to the invention by the combination of the following features:

(a) the work table is attached substantially level with the rear ends of the goods display mounting plates placed on the inclined floor in the display structure;

(b) the goods display mounting plates are detachable or separate, independent, rectangular and identical or of standard size;

(c) an upwardly protruding lip is provided along a free rear longitudinal edge of the work table which extends the length of the case; and (d) the table and its lip are so constructed that the space between the rears of the goods display plates and the lip is equal to or greater than the width of the plates but is less than the lengths of the plates.

By employing these features in the display case of this invention, the intermediate display mounting structures for putting goods in the display structures found in the known display cases can be omitted, which results in a better view and accessibility for the goods. The plates can be placed longitudinally or transversely on the table and fully display the goods thereon.

A capacity for goods display at least as large as that of prior art display cases is provided by means of the goods display plates or the like and the work table of this invention. The goods positioned on the work table and on the accompanying goods display mounting plates provide a good viewing for the customer and also have an improved accessibility for the seller.

In addition, it is possible to place on the goods display mounting plates baskets for storage and presentation of bread or to use such baskets instead of nonperforated plates as the display members.

Accidental bodily contact with the goods is considerably reduced because of the presence of the lip on the edge of the work plate and a high level of local safety for the goods will also be achieved. In addition the foregoing lip permits the rectangular goods display plates to be arranged on the work plate or table optionally lengthwise extending the length of the work table long side and therefore horizontally or by a rotation about 90° from the previously described position to a position where the end portions of the goods display mounting plates are propped on the lip so that then the goods display plates are inclined downwardly toward the front slantingly so that the viewing by the buyer is improved.

Therefore it is a further useful feature to construct the lip so that its height at least exceeds that of a goods display member, on the one hand to decrease the danger of an accidental bodily contact with the goods still further, and on the other hand to obtain a still greater inclination of the goods display plates on the work table.

A development that eases the handling of the goods display plates on the work table and in the display case consists in forming the goods display plates so that they are identical in dimensions and area, i.e. are congruent.

The goods display plates may thus be equally advantageously employed on the work table or in the display structure.

A further advantageous refinement of the above-described novel display case provides means for varying the distance of the lip from the back end of the work plate selectively. The lip can thus be moved across the work plate transversely to the longitudinal edge of the work plate and can be supported by limitedly-movable feed bars, whereby the displacement of the lip corresponds at least to the difference of the length from the width of the goods display plates or the like positioned on the work plate It is therefore possible to put the goods display mounting plates or the like on the work plate as one chooses, even horizontally, when they are directed so that their long sides are transverse to the long edges of the work plate, by increasing the distance of the lip from the goods display plates found in the structure.

As an additional improvement for the presentation of goods by the seller, the work plate or table may be divided up into a plurality of work plate segments together with its lip. These work plate segments are positionable lengthwise one after another and may be connected together. Each work plate segment is constructed with its front side end portion pivotally attached to the display case and its rear end portion raisable from the horizontal as well as constructed detachably fastenable in the raised position.

Thereby the work plate segments should be constructed independently from one another but so that they can be fixed in contiguous horizontal relationship.

It is advantageous for the width of the work plate segments to be at least equal to the width of one of the display mounting plates or the like positioned on the work plate.

To hold the work plate segments slanting toward the front and raised behind, additional supports may be provided, which, for example, may be wedge-shaped and should be positioned across the longitudinal side of the work plate. Also bar-like firmly-holding raisable supports are possible for a detachable stop for the work plate segments.

BRIEF DESCRIPTION OF THE DRAWINGS

The above and other objects, features and advantages of the invention will become more readily apparent from the following description, reference being made to the accompanying drawing, in which.

SPECIFIC DESCRIPTION

Figure 1:
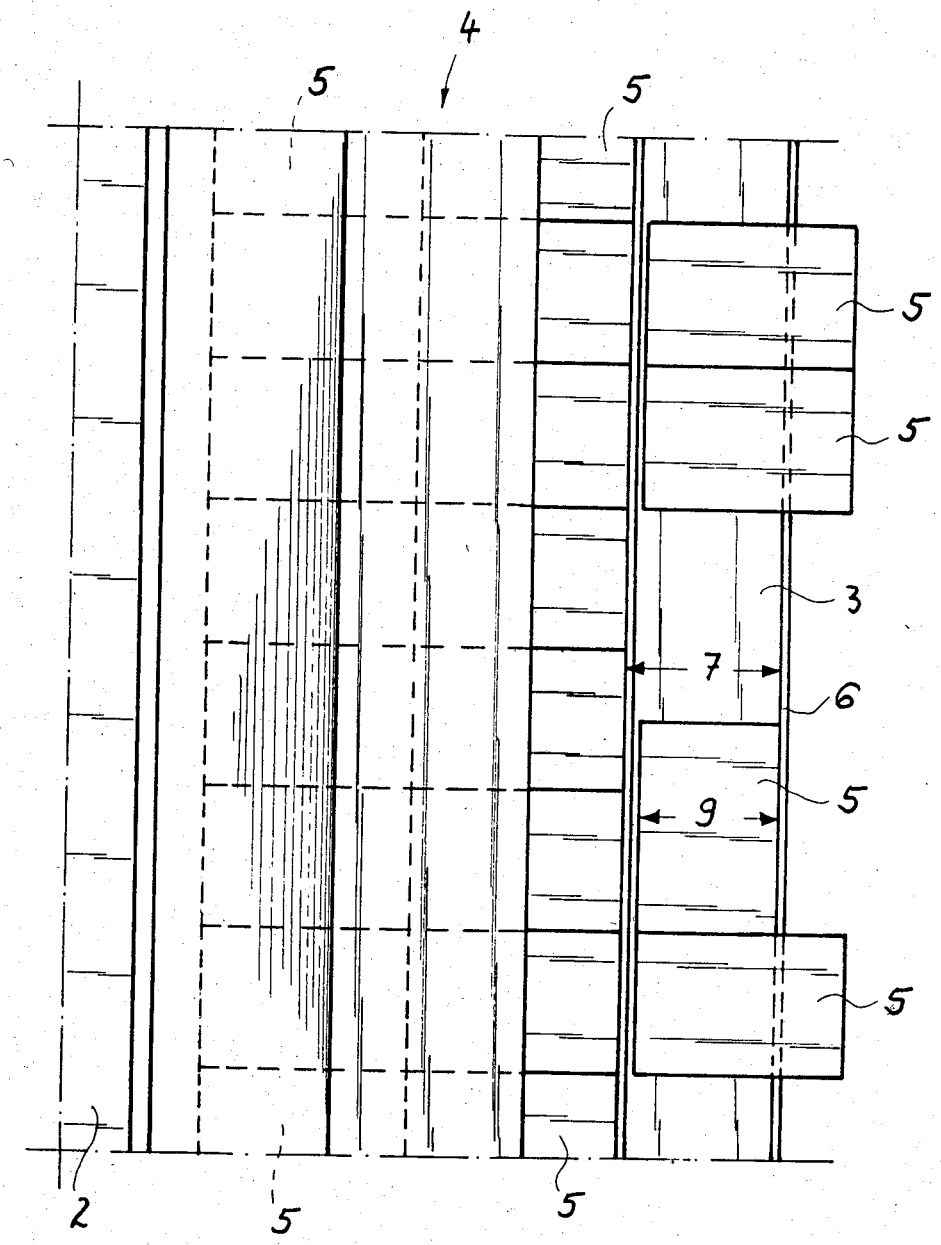
FIG. 1 is a diagrammatic top plan view of an embodiment of the novel sales display case of this invention.
Figure 2:
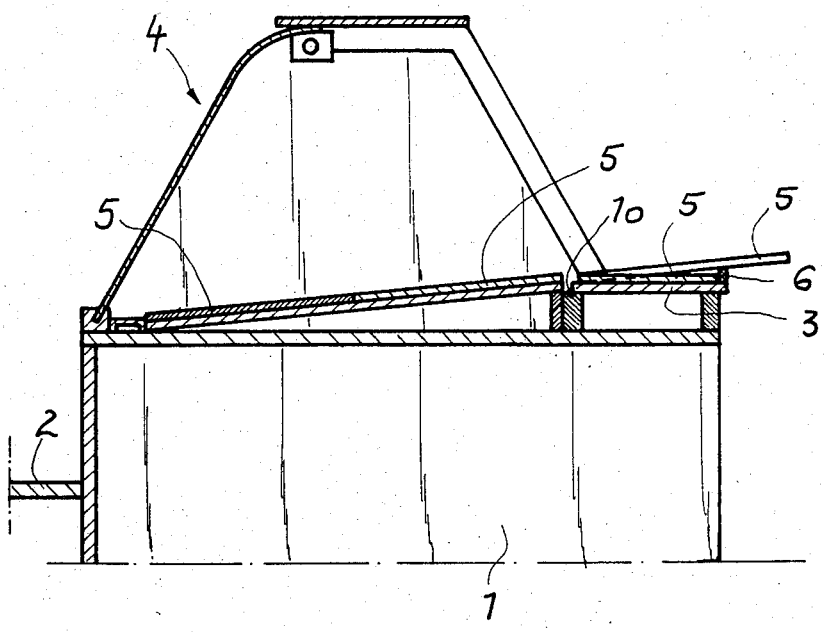
FIG. 2 is a vertical cross-sectional view of the embodiment of FIG. 1.

The sales display case of this invention as shown in FIGS. 1 and 2 comprises a cabinet or shelflike support base 1, a front (customer) side positioned shelf 2 for bags and the like, a rear (vendor side) work plate or table 3, a display structure 4 which is rear-opening and transparent at least in front, and a plurality of side-by-side rectangular goods display mounting plates 5 which are placed on the floor of the display structure 4 or the work plate or table 3.

In the embodiment of FIG. 1 all the goods mounting plates 5 are constructed to be of the same dimensions. The rear end portions (i.e. the edges closest to the vendor side) of the goods display plates 5 placed on the display structure 4 inclined toward the front are approximately level with additional goods display plates 5 placed on the work table 3. At the back long edge of the work table 3 which stretches across the entire length of the case an upwardly protruding lip 6 is attached to work plate 3 at a distance 7 from the rear end portion of the display structure 4, on the one hand which corresponds at least to the width 9 of a goods display plate 5, but on the other hand is smaller than the length of a goods display plate 5. The height of the lip, as seen in FIG. 2, can exceed the thickness of a goods display plate 5.

The goods display plate 5 can be either horizontal or, in the same manner as the goods display plates 5 in the display structure 4 itself, can be inclined downwardly and forwardly when the goods display plate 5 is supported at its rear end on the lip 6.

Furthermore the entire work table 3 at its front end portion on support base 1 is pivoted rotatably upward about its horizontal axis 10 to be able to show goods on the work plate 3 at a greater inclination than by merely resting the plate on the lip 6 of the horizontal table. Shims may be provided between work plate 3 and the support base 1 so as to be able to fix the rear of the work plate 3 into a lifted position. Another possibility for detachably supporting the raised work plate 3 comprises use of positionable rodlike supports rising from the support base 1.

Figure 3:
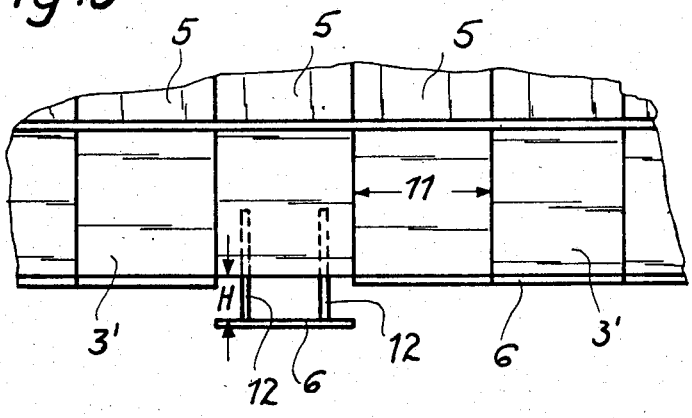
FIG. 3 is a detail plan view illustrating another embodiment.

According to FIG. 3, work table 3 is divided into several closely positioned side-by-side work plate segments 3'. The width 11 of the work plate segments 3' corresponds to the width 9 of the goods display plates 5. Each work plate segment 3' is pivotably liftable independently from the other wherein the rotation axes of all the work plate segments 3' are positioned horizontal and coaxial to one another. An individual lip 6 is positioned on each work plate segment 3' and held at the rear edge of the work plate segment 3' by two parallel movable guide rods 12. The maximum displacement H of the lip 6 amounts at least to the difference of the width from the length of goods display plates 5.

We claim:

1. In a sales display case for goods including baked products and confectionaries comprising a base with a horizontal work table attached to a rear portion of said base and extending across the entire length of the case, a transparent rearwardly open display structure on said base, and a plurality of identical rectangular goods display members positioned on a floor of said display structure so as to be inclined toward the front thereof and each having a length and a width, the improvement wherein:

said table is substantially level and said goods display members positioned on said floor in said display structure have rearwardly directed ends;

said goods display members are detachable and independent;

an upwardly protruding lip is formed on a free rear longitudinal edge of said table;

a spacing is provided between the rearwardly directed ends of said goods display members placed in said display structure and said lip on said table and said spacing is at least equal to the widths and is smaller than the lengths of said goods display members;

said lip has a height at least equal to a thickness of said goods display members;

said lip is movable transversely to said longitudinal edge of said table to provide a limited transverse displacement thereof, whereby the maximum displacement of said lip equals at least a difference between the length and the width of said goods display plates;

said table with said lip is divided into a plurality of work plate segments positionable side-by-side with long sides of said segments parallel to each other; and each of said work plate segments is rotatable about a pivot at a front end portion proximal to said display structure and has a rear end portion of said work plate segment liftable from the horizontal to a raised position.

2. The improvement defined in claim 1 wherein said table is substantially rectangular in shape.

3. The improvement defined in claim 1 wherein said display structure has an upwardly and rearwardly inclined transparent member through which goods on said goods display members on said floor and resting on said lip are readily visible.

4. The improvement defined in claim 1 wherein said work plate segments are provided with means enabling them to be movable independently of one another and held at a fixed position.

5. The improvement defined in claim 4 wherein the widths of said work plate segments are identical and substantially equal to the widths of said goods display plates.

* * * * *